US010618760B2

(12) United States Patent
Ishioka et al.

(10) Patent No.: US 10,618,760 B2
(45) Date of Patent: Apr. 14, 2020

(54) SHEET CONVEYANCE APPARATUS

(71) Applicant: CANON KABUSHIKI KAISHA, Tokyo (JP)

(72) Inventors: Naoki Ishioka, Matsudo (JP); So Matsumoto, Koshigaya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/038,666

(22) Filed: Jul. 18, 2018

(65) Prior Publication Data

US 2019/0023511 A1 Jan. 24, 2019

(30) Foreign Application Priority Data

Jul. 24, 2017 (JP) ..... 2017-143099

(51) Int. Cl.
*B65H 9/16* (2006.01)
*B65H 5/06* (2006.01)
*B65H 7/02* (2006.01)

(52) U.S. Cl.
CPC ..... *B65H 9/166* (2013.01); *B65H 5/062* (2013.01); *B65H 7/02* (2013.01);
(Continued)

(58) Field of Classification Search
CPC ..... B65H 9/166; B65H 2301/3412; B65H 5/062; B65H 2513/108; B65H 2404/1451; B65H 2515/34
See application file for complete search history.

(56) References Cited

U.S. PATENT DOCUMENTS 4,266,762 A * 5/1981 Kramer ..... B65H 9/166 271/186
5,253,862 A * 10/1993 Acquaviva ..... B65H 9/166 271/227

(Continued)

FOREIGN PATENT DOCUMENTS

JP 09-025026 A 1/1997
JP 10-239945 A 9/1998

(Continued)

OTHER PUBLICATIONS

U.S. Appl. No. 16/038,850, Jun Nakamura So Matsumoto, filed Jul. 18, 2018.

(Continued)

*Primary Examiner* — Patrick Cicchino
(74) *Attorney, Agent, or Firm* — Venable LLP

(57) ABSTRACT

A sheet conveyance apparatus includes an oblique-feed unit configured to nip and convey a sheet by imparting to the nipped sheet a force in a direction inclined relative to a sheet conveyance direction so that the sheet approaches an abutment surface in the width direction as the sheet proceeds downstream in the sheet conveyance direction; a drive unit configured to drive the oblique-feed unit; a change unit configured to change the force of the oblique-feed unit; and a control unit configured to control the drive unit and the change unit so that, after causing the sheet to abut against the abutment surface in a first state in which the oblique-feed unit is driven at a first speed, the oblique-feed unit is put into a second state in which the oblique-feed unit is driven at a second speed higher than the first speed and the force is weaker than in the first state.

8 Claims, 11 Drawing Sheets

(52) U.S. Cl.
CPC ..... *B65H 2301/3412* (2013.01); *B65H 2404/1441* (2013.01); *B65H 2404/1451* (2013.01); *B65H 2513/108* (2013.01); *B65H 2513/53* (2013.01); *B65H 2515/34* (2013.01); *B65H 2701/1311* (2013.01); *B65H 2801/06* (2013.01)

(56) References Cited

U.S. PATENT DOCUMENTS

| | | | | |
|---|---|---|---|---|
| 6,273,418 | B1 | 8/2001 | Fujikura et al. | |
| 7,658,379 | B2 | 2/2010 | Yasumoto | |
| 7,942,411 | B2 | 5/2011 | Ishioka | |
| 8,123,218 | B2 | 2/2012 | Yasumoto | |
| 8,308,160 | B2 * | 11/2012 | Miyazawa | B65H 5/062 271/251 |
| 8,342,518 | B2 | 1/2013 | Matsumoto | |
| 8,684,353 | B2 * | 4/2014 | Miyazawa | B65H 7/02 271/250 |
| 9,193,546 | B2 | 11/2015 | Nakamura | |
| 9,206,005 | B2 | 12/2015 | Fujita et al. | |
| 9,550,643 | B2 * | 1/2017 | Matsumoto | B65H 5/062 |
| 9,714,149 | B2 * | 7/2017 | Gillier | B65H 9/166 |
| 9,938,101 | B2 * | 4/2018 | Watanabe | B65H 5/062 |
| 10,160,237 | B2 * | 12/2018 | Herrmann | B65H 9/16 |
| 2017/0088375 | A1 | 3/2017 | Matsumoto et al. | |
| 2019/0025748 | A1 | 1/2019 | Nakamura et al. | |
| 2019/0025749 | A1 | 1/2019 | Iwasaki et al. | |
| 2019/0025750 | A1 | 1/2019 | Matsumoto et al. | |

FOREIGN PATENT DOCUMENTS

| | | | | |
|---|---|---|---|---|
| JP | 11-189355 | A | | 7/1999 |
| JP | 2008-050082 | A | | 3/2008 |
| JP | 2008050082 | A | * | 3/2008 |
| JP | 2009-091095 | A | | 4/2009 |
| JP | 2015-199551 | A | | 11/2015 |

OTHER PUBLICATIONS

U.S. Appl. No. 16/038,862, Hisanori Iwasaki So Matsumoto, filed Jul. 18, 2018.

U.S. Appl. No. 16/038,891, So Matsumoto Koki Sato Daisuke Yamabe, filed Jul. 18, 2018.

* cited by examiner

SHEET CONVEYANCE APPARATUS

BACKGROUND OF THE INVENTION

Field of the Invention

The present invention relates to a sheet conveyance apparatus which conveys sheets.

Description of the Related Art

Sheet conveyance apparatuses which convey sheets in image forming apparatuses include apparatuses which perform skew-feed correction according to a side registration method with respect to sheets. In such sheet conveyance apparatuses, a sheet is shifted towards the side of a reference member disposed at the side of a sheet conveyance path by an oblique-feed roller, and a side edge of the sheet is caused to abut against the reference member to thereby correct an inclination of the sheet. For example, in Japanese Patent Application Laid-Open No. H11-189355, a sheet alignment apparatus is described that performs skew-feed correction by causing the side edge of a sheet to abut against a reference guide by means of a plurality of rollers arranged along a sheet conveyance path.

In Japanese Patent Application Laid-Open No. 2008-50082 a sheet conveyance apparatus is described that employs a method that temporarily decelerates the driving speed of an oblique-feed roller when a sheet butts against a reference side plate, and accelerates the driving speed of the oblique-feed roller after the sheet butts against the reference side plate. According to this configuration, it is attempted to reduce damage to a sheet caused by an impact between the sheet and the reference side plate by decelerating the oblique-feed roller, and to secure productivity by accelerating the driving speed of the oblique-feed roller thereafter.

However, when adopting a configuration that accelerates the driving speed of an oblique-feed roller during the course of an operation that conveys a sheet as in the sheet conveyance apparatus described in Japanese Patent Application Laid-Open No. 2008-50082, in some cases turning of the sheet occurs after the sheet is butted against the reference side plate. In such a case, the accuracy of skew-feed correction is reduced by the turning of the sheet, and there is a concern that the sheet will collide with the edge of the reference side plate and be damaged.

SUMMARY OF THE INVENTION

Therefore, the present invention provides a sheet conveyance apparatus configured to suppress turning of a sheet.

A sheet conveyance apparatus according to one aspect of the present invention, comprises:

an abutment surface extending along a sheet conveyance direction and configured to abut against an edge, in a width direction orthogonal to the sheet conveyance direction, of a sheet passing through a sheet conveyance path;

an oblique-feed unit configured to convey the sheet by imparting to the sheet nipped a force in a direction inclined relative to the sheet conveyance direction so that the sheet approaches the abutment surface in the width direction as the sheet proceeds downstream in the sheet conveyance direction;

a drive unit configured to drive the oblique-feed unit;

a change unit configured to change a force with which the oblique-feed unit nips the sheet; and a control unit configured to control the drive unit and the change unit so that, after causing the sheet to abut against the abutment surface in a first state in which the oblique-feed unit is driven at a first speed, the oblique-feed unit is put into a second state in which the oblique-feed unit is driven at a second speed higher than the first speed and the force with which the oblique-feed unit nips the sheet is weaker than in the first state.

Further features of the present invention will become apparent from the following description of exemplary embodiments with reference to the attached drawings.

DESCRIPTION OF THE EMBODIMENTS

Figure 1:
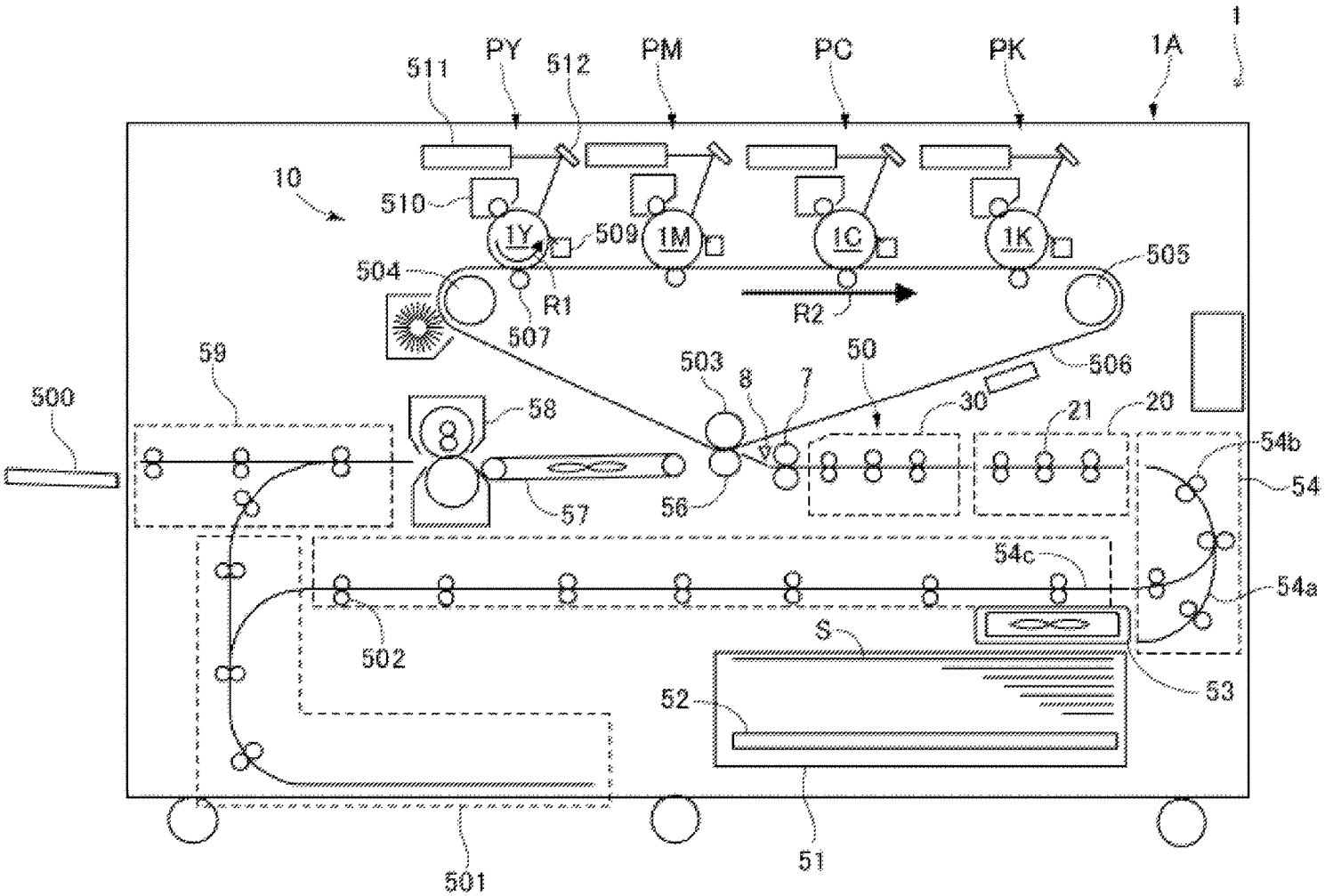
FIG. 1 is a schematic diagram of an image forming apparatus according to the present embodiment.

Hereunder, an image forming apparatus according to the present disclosure will be described referring to the drawings. Image forming apparatuses include printers, copiers, facsimile machines and multifunction peripherals, and form an image on a sheet that is used as a recording medium based on image information that is input from an external PC or image information that is read from an original.

(General Outline of Image Forming Apparatus)

The sheet conveyance apparatus according to the present disclosure constitutes one part of an image forming apparatus 1 that is an electrophotographic full-color laser printer which is illustrated in FIG. 1. The image forming apparatus 1 is a print on demand (POD) machine that is capable of supporting printing for uses other than general office uses, and can use various kinds of sheets such as paper sheets and envelopes, glossy paper, plastic film such as sheet for an overhead projector (OHT), and fabric or the like as recording media. A feeding cassette 51 that houses sheets S, and an image forming engine 10 that forms an image on a sheet S that was fed from the feeding cassette 51 are housed in an apparatus main body 1A of the image forming apparatus 1. The image forming engine 10 that is one example of an image forming unit employs a tandem-type intermediate transfer system that includes four image forming portions PY, PM, PC and PK that form toner images of yellow, magenta, cyan and black, and an intermediate transfer belt 506 that is an intermediate transfer member. The image forming portions PY to PK are electrophotographic units which have photosensitive drums 1Y, 1M, 1C and 1K that are photosensitive members, respectively.

The image forming portions PY to PK have the same configuration as each other except that the colors of the toner which the image forming portions PY to PK use for developing are different from each other. Therefore, the configuration of the image forming portions and the process for forming a toner image (image forming operation) will be described taking the image forming portion PY for yellow as an example. The image forming portion PY includes, in addition to the photosensitive drum 1Y, an exposure device 511, a developing device 510 and a drum cleaner 509. The photosensitive drum 1Y is a drum-like photosensitive member having a photosensitive layer at an outer circumferential portion, and rotates in a direction (arrow R1) along the rotational direction (arrow R2) of the intermediate transfer belt 506. The surface of the photosensitive drum 1Y is charged by being supplied with an electric charge from a charging unit such as a charging roller. The exposure device 511 is configured to emit a laser beam modulated in accordance with image information, and to form an electrostatic latent image on the surface of the photosensitive drum 1Y by scanning the photosensitive drum 1Y by means of an optical system that includes a reflecting device 512. The developing device 510 contains developer that includes toner, and develops the electrostatic latent image into a toner image by supplying toner to the photosensitive drum 1Y. The toner image formed on the photosensitive drum 1Y is subjected to a primary transfer onto the intermediate transfer belt 506 at a primary transfer portion that is a nip portion between a primary transfer roller 507 that is a primary transfer device and the intermediate transfer belt 506. Residual toner which remains on the photosensitive drum 1Y after the transfer is removed by the drum cleaner 509.

The intermediate transfer belt 506 is wound around a driving roller 504, a driven roller 505, a secondary transfer inner roller 503 and the primary transfer roller 507, and is rotationally driven in the clockwise rotation direction (arrow R2) in FIG. 1 by the driving roller 504. The aforementioned image forming operation proceeds in parallel at each of the image forming portions PY to PK, and a full-color toner image is formed on the intermediate transfer belt 506 by toner images of four colors being transferred in multiple layers so as to be superimposed on each other. The toner image is carried by the intermediate transfer belt 506 and conveyed to a secondary transfer portion. The secondary transfer portion is configured as a nip portion between a secondary transfer roller 56 as a transfer unit and the secondary transfer inner roller 503, and is a portion at which the toner image is subjected to a secondary transfer onto the sheet S by application of a bias voltage that is of reverse polarity to the charge polarity of the toner to the secondary transfer roller 56. Residual toner which remains on the intermediate transfer belt 506 after the transfer is removed by a belt cleaner.

The sheet S onto which the toner image was transferred is delivered to a fixing unit 58 by a pre-fixing conveyance portion 57. The fixing unit 58 has a pair of fixing rollers that nip and convey the sheet S and a heat source such as a halogen heater. The fixing unit 58 pressurizes and heats the toner image that is being borne on the sheet S. By this means, toner particles melt and adhere to the sheet S to thereby obtain a fixed image that is fixed to the sheet S.

Next, the configuration and operations of a sheet conveyance system that feeds a sheet S stored in the feeding cassette 51, and discharges the sheet S on which an image is formed to outside of the machine body will be described. The sheet conveyance system broadly includes a sheet feeding portion 54, a registration portion 50, a branching conveyance portion 59, a reverse conveyance portion 501, and a two-sided conveyance portion 502.

The feeding cassette 51 is mounted in the apparatus main body 1A in a manner in which the feeding cassette 51 can be drawn out therefrom, and sheets S that are loaded on an ascending/descending plate 52 which is capable of ascending and descending are fed one sheet at a time by a feeding unit 53. A belt system in which a sheet S is sucked onto a belt member by a suction fan and conveyed (see FIG. 1), or a frictional separation system that uses a roller or a pad may be mentioned as examples of the feeding unit 53 that is a sheet feeding unit. The sheet S that is sent out from the feeding unit 53 is conveyed along a feeding path 54*a* by pairs of conveying rollers 54*b* and is delivered to the registration portion 50.

The registration portion 50 includes a pre-registration conveyance portion 20, a skew-feed correction portion 30, and a pair of registration rollers (hereunder, referred to as "registration rollers") 7. The registration portion 50 corrects a skew of the sheet S and conveys the sheet S toward the secondary transfer portion. At this time, based on a detection signal of a registration sensor 8, the registration rollers 7 feed the sheet S into the secondary transfer portion at a timing that is in accordance with the degree of progression of the image forming operations by the image forming portions PY to PK. At the secondary transfer portion, the sheet S onto which the toner image was transferred and for which fixing of an image was performed by the fixing unit 58 is conveyed to the branching conveyance portion 59 which has a changeover member that is capable of switching the conveyance route of the sheet S. In a case where image formation with respect to the sheet S is completed, the sheet S is discharged to a discharge tray 500 disposed on the outside of the apparatus main body 1A by a pair of discharge rollers. In the case of forming an image on the rear face of the sheet S, the sheet S is delivered to the two-sided conveyance portion 502 via the reverse conveyance portion 501. The reverse conveyance portion 501 has a pair of reversing rollers that are capable of forward rotation and reverse rotation, and switches back the sheet S to deliver the sheet S to the two-sided conveyance portion 502. The two-sided conveyance portion 502 conveys the sheet S toward the pre-registration conveyance portion 20 via a re-conveying path 54*c* that merges with the feeding path 54*a*. Subsequently, after an image is formed on the rear face of the sheet S, the sheet S is discharged to the discharge tray 500.

Note that the above described configuration is one example of an image forming apparatus, and the image forming apparatus may also be, for example, an image forming apparatus that includes an image forming unit that adopts an inkjet system instead of an electrophotographic system. Further, some image forming apparatuses also include additional equipment such as an optional feeder or a sheet processing device in addition to the apparatus main body that includes an image forming unit, and the configuration of the sheet conveyance apparatus that is described hereunder may be used for conveying sheets in such kind of additional equipment.

(Registration Portion)

Hereunder, the configuration of a registration portion 50 that includes a skew-feed correction portion 30 will be described. As illustrated in FIG. 2A, FIG. 2B, FIG. 2C and FIG. 2D, the registration portion 50 that is one example of a sheet conveyance apparatus includes a pre-registration conveyance portion 20, a skew-feed correction portion 30 that is disposed downstream of the pre-registration conveyance portion 20, and registration rollers 7 that are disposed downstream of the skew-feed correction portion 30.

The pre-registration conveyance portion 20 has at least one pair of conveying rollers 21, and each pair of conveying rollers 21 sends the sheet S in the sheet conveyance direction Dx. The pre-registration conveyance portion 20 conveys the sheet S according to a center reference system, that is, so that the center of the sheet S with respect to a width direction Dy that is orthogonal to the sheet conveyance direction Dx is aligned with a center position (hereunder, referred to as "conveyance center") L0 of the sheet conveyance path. In the case of the configuration example illustrated in the drawing, the position of the conveyance center L0 is a center position in the width direction Dy of a region in which the pair of conveying rollers 21 are capable of nipping the sheet S, that is, a region where the rollers can contact each other.

A pre-registration sensor Sa as a detector for detecting the sheet S is disposed at a position that is in the vicinity of the most downstream pair of conveying rollers 21 and is in the vicinity of the conveyance center L0. For example, a reflection-type photoelectric sensor that has a light emitting portion and a light receiving portion can be used as the pre-registration sensor Sa, and in such case a light that is emitted from the light emitting portion upon the sheet S arriving at the detection position is reflected, and the reflected light is detected by the light receiving portion to thereby detect the timing at which the sheet S passes the detection position.

The skew-feed correction portion 30 is a sheet alignment apparatus which adopts a side registration method and which includes a reference member 300 and an oblique-feed unit 32. That is, the skew-feed correction portion 30 causes a side edge, that is, an edge in a width direction Dy that is orthogonal to the sheet conveyance direction Dx, of the sheet S to abut against the reference member 300 having a reference face 301 extending along the sheet conveyance direction. By this means, a skew of the sheet S is corrected by causing the side edge of the sheet S to follow the reference face 301. Here, the term "sheet conveyance direction Dx" refers to the conveyance direction of the sheet before the sheet S is shifted towards the side in the direction of the reference member by the skew-feed correction portion 30, and in the present embodiment the term "sheet conveyance direction" is taken as indicating the direction in which the sheet S is conveyed by pairs of conveying rollers 21 of the pre-registration conveyance portion 20.

The reference member 300 has a reference face 301 that extends in the sheet conveyance direction Dx, and is disposed on either side of the sheet conveyance path with respect to the width direction Dy. The reference face 301 extends along the sheet conveyance direction, and corresponds to an abutment surface that is capable of abutting against a side edge of a sheet. The oblique-feed unit 32 is disposed, with respect to the width direction, on the same side as the reference member 300 relative to the conveyance center L0. The oblique-feed unit 32 has at least one of oblique-feed rollers 321, 322 and 323, and in the example illustrated in the drawing, three oblique-feed rollers are disposed.

The oblique-feed rollers 321 to 323 are roller members which rotate around an axis that is inclined with respect to the width direction Dy. That is, the oblique-feed rollers 321 to 323 are disposed in parallel to each other so that a tangential direction to a contact portion with respect to the sheet S is a direction that is inclined at an angle $\alpha$ relative to the sheet conveyance direction Dx. Accordingly, by the oblique-feed unit 32 contacting against the sheet S and rotating, as the sheet S progresses downstream in the sheet conveyance direction Dx, a conveying force is imparted to the sheet S in a direction that is inclined so as to make the sheet S approach the reference face 301 of the reference member 300 in the width direction Dy.

The registration rollers 7 are capable of sliding in the width direction Dy in a state in which the registration rollers 7 nip the sheet S, and move the sheet S whose side edge had contacted against the reference face 301 of the reference member 300 in the width direction Dy in conformity with the position of an image to be transferred at the secondary transfer portion. Note that the reference member 300 and the oblique-feed unit 32 are also movable in the width direction Dy, and are positioned in advance in accordance with the width of the sheet S that is to be conveyed. Further, a method for performing position adjustment between a sheet and an image to be formed on the sheet is not limited to the foregoing method, and for example a configuration may be adopted which fixes the width direction positions of the reference member 300 and the registration rollers 7, and adjusts the position in the main scanning direction of toner images that the image forming portions PY to PK form.

A registration sensor Sb as a detector that is capable of detecting the sheet S is disposed at a position which is in the vicinity of the upstream side of the registration rollers 7 and in the vicinity of the conveyance center L0. Similarly to the pre-registration sensor Sa, a known sensor such as a reflection-type photoelectric sensor can be used as the registration sensor Sb.

The respective pairs of conveying rollers 21 and the registration rollers 7 of the pre-registration conveyance portion 20 are each an example of a sheet conveyance unit that is capable of conveying a sheet in the sheet conveyance direction. Among these, the pair of conveying rollers 21 corresponds to a first conveyance unit that delivers a sheet to the first oblique-feed unit and the second oblique-feed unit, and the registration rollers 7 correspond to a second conveyance unit that receives and conveys a sheet that was subjected to oblique feeding by the first oblique-feed unit and the second oblique-feed unit.

(Pre-registration Conveyance Portion)

Figure 3A:
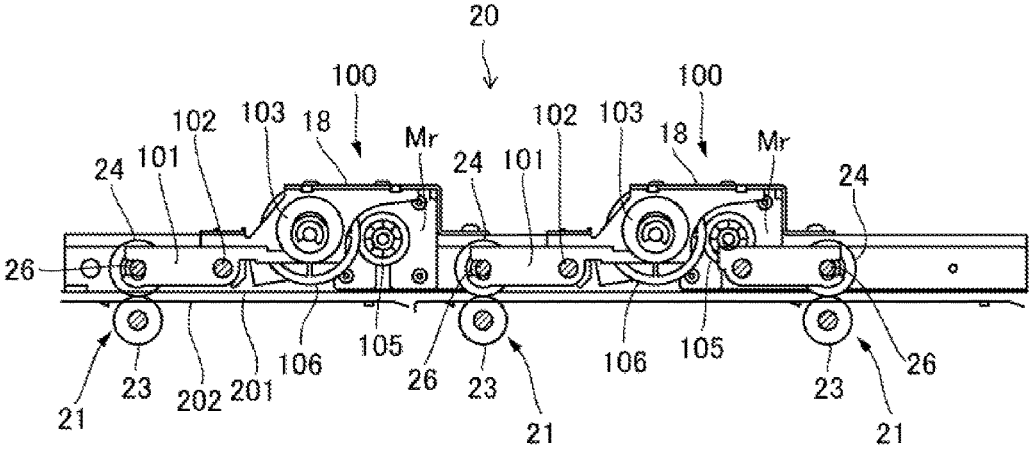
FIG. 3A is a schematic diagram showing the cross-sectional configuration of a pre-registration conveyance portion that is in a pressure state.
Figure 3B:
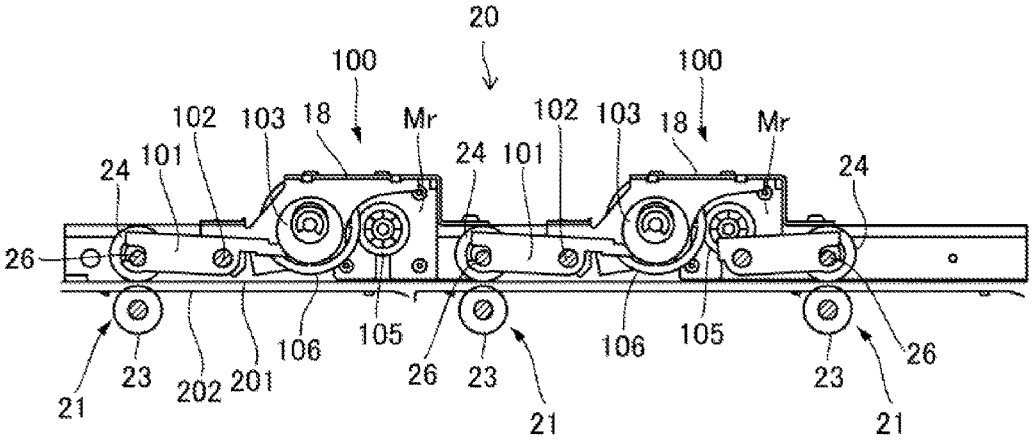
FIG. 3B is a schematic diagram showing the cross-sectional configuration of the pre-registration conveyance portion that is in a released state.
Figure 4:
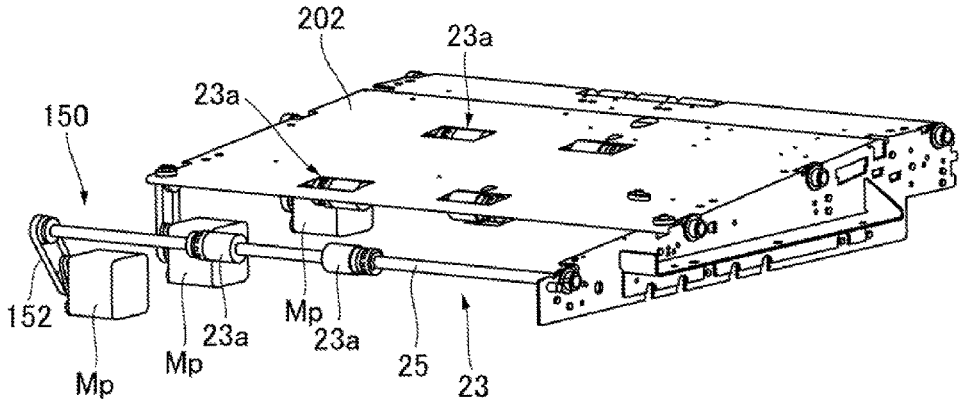
FIG. 4 is a perspective view illustrating the driving configuration of the pre-registration conveyance portion.

Hereunder, the configuration of the pre-registration conveyance portion 20 and the skew-feed correction portion are described, and thereafter a sheet conveying operation by the registration portion 50 will be described. First, the configuration of the pre-registration conveyance portion 20 will be described using FIG. 3A, FIG. 3B and FIG. 4. FIG. 3A and FIG. 3B are schematic diagrams illustrating the cross-sectional configuration of the pre-registration conveyance portion 20. FIG. 4 is a perspective view illustrating the driving configuration of the pair of conveying rollers 21.

As illustrated in FIG. 3A and FIG. 3B, each pair of conveying rollers 21 of the pre-registration conveyance portion 20 is constituted by a driving roller 23 into which a driving force is input, and a driven roller 24 that is driven to rotate by the driving roller 23. At least some of the pairs of conveying rollers 21 are switchable between a pressure state (FIG. 3A) in which the conveying rollers 21 can nip the sheet S at a nip portion and a separated state (FIG. 3B) in which the nip portion is opened. Note that, whether or not to make all of the pairs of conveying rollers 21 switchable between a pressure state and a separated state can be decided in accordance with the maximum size of the sheets S that the image forming apparatus supports. That is, it suffices that, in a case where an operation to shift the sheet S toward the side is started by the oblique-feed unit 32, the configuration enables the separation of all of the pair of conveying rollers 21 at which a rear edge of the sheet is not passing through a nip portion. By this means, it is possible to prevent the occurrence of a situation in which pairs of conveying rollers 21 hinder the operation to shift the sheet S towards the side, and also to avoid the occurrence of damage to the sheet S due to friction or stress applied to the sheet S.

A cam mechanism 100 having an eccentric roller 103 is provided in the pre-registration conveyance portion 20 as a changeover unit that is capable of switching between a pressure state and a separated state of the pair of conveying rollers 21. The eccentric roller 103 is rotationally driven through gears 105 and 106 by a pre-registration pressure motor Mr as a drive source, and rocks an arm member 101 that contacts against a cam face of an outer circumferential portion. The arm member 101 is rockably supported with respect to a stay member 18 around a rocker shaft 102, and contacts against the eccentric roller 103 on one side of the rocker shaft 102, and supports a driven shaft 26 that is a rotational shaft of the driven roller 24 on the other side. When the arm member 101 rocks, the driven roller 24 enters and exits a sheet conveyance path formed by guide members 201 and 202. Accordingly, the configuration enables switching between a separated state in which the driven roller 24 is separated from the driving roller 23 and a pressure state in which the driven roller 24 presses against the driving roller 23, by controlling the rotational angle of the eccentric roller 103 through a pre-registration pressure motor Mr that is a stepping motor.

As illustrated in FIG. 4, each driving roller 23 is constituted by attaching rubber rollers 23*a* onto a driving roller shaft 25, and is connected to a pre-registration drive motor Mp that is a drive source through a belt power transmission mechanism 152. Each pre-registration drive motor Mp is a stepping motor, and the timings for starting and stopping driving as well as the driving speed (circumferential speed of rubber rollers 23*a*) of the driving roller 23 are changeable.

(Skew-feed Correction Portion)

Figure 5A:
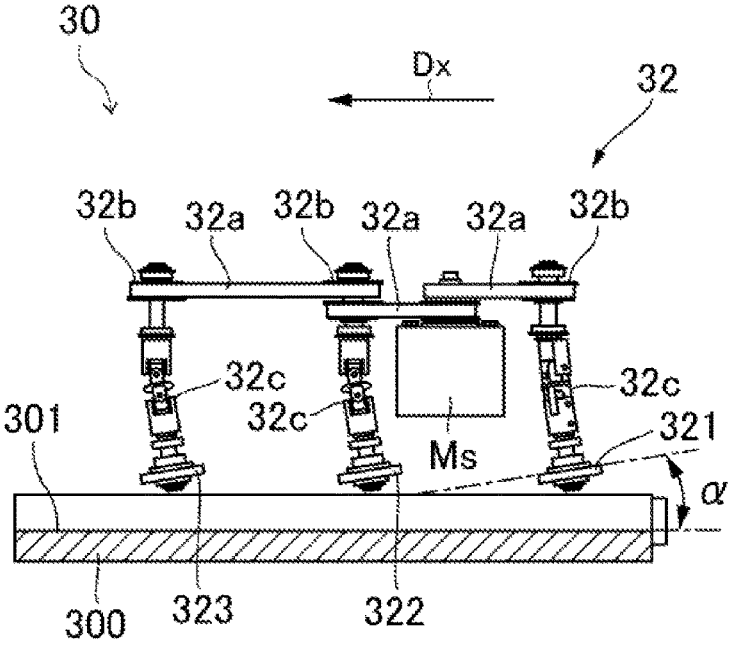
FIG. 5A is a plan view illustrating an outline of a skew-feed correction portion.
Figure 5B:
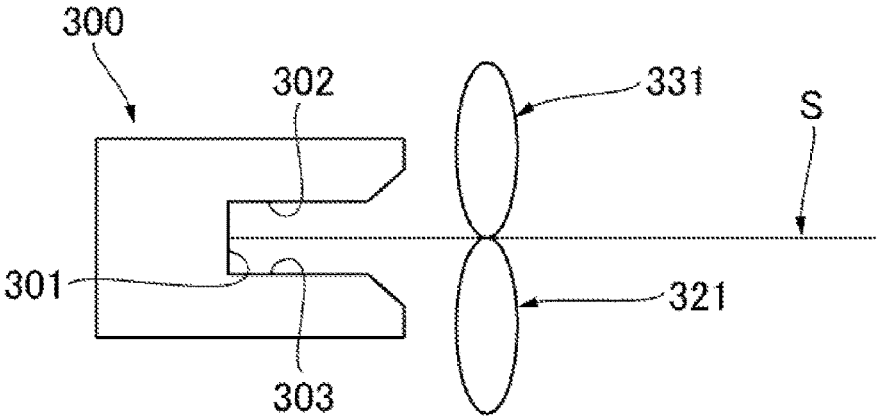
FIG. 5B is a schematic diagram illustrating the cross-sectional configuration of a reference member.
Figure 6A:
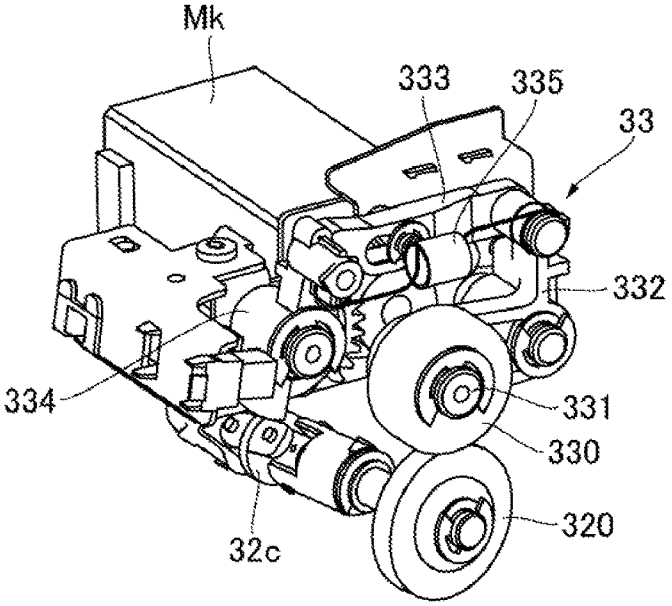
FIG. 6A is a perspective view illustrating a pressing mechanism of an oblique-feed roller.
Figure 6B:
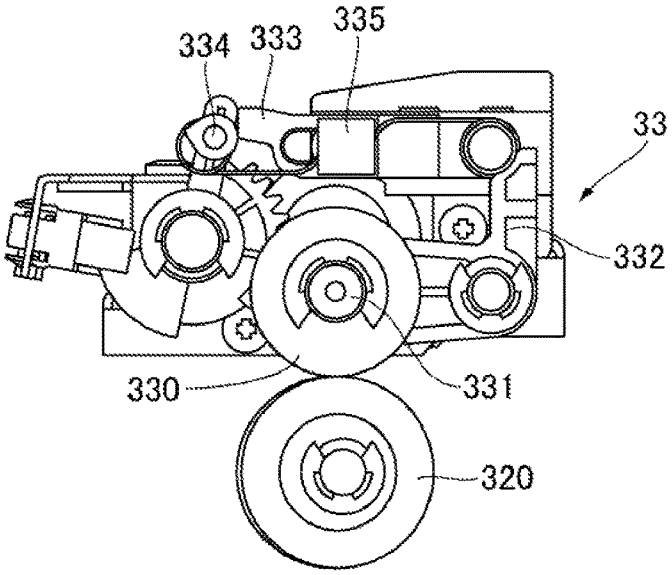
FIG. 6B is a side view illustrating the pressing mechanism of the oblique-feed roller.
Figure 7A:
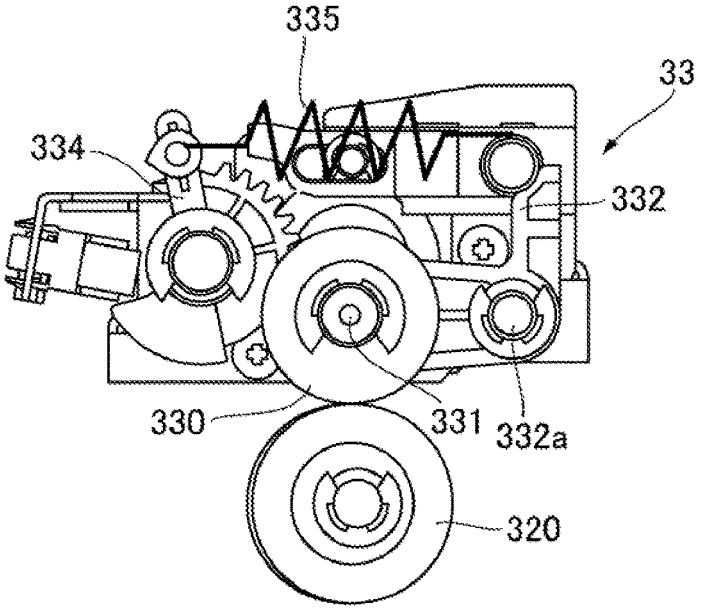
FIG. 7A is a side view illustrating the pressing mechanism in a pressure state.
Figure 7B:
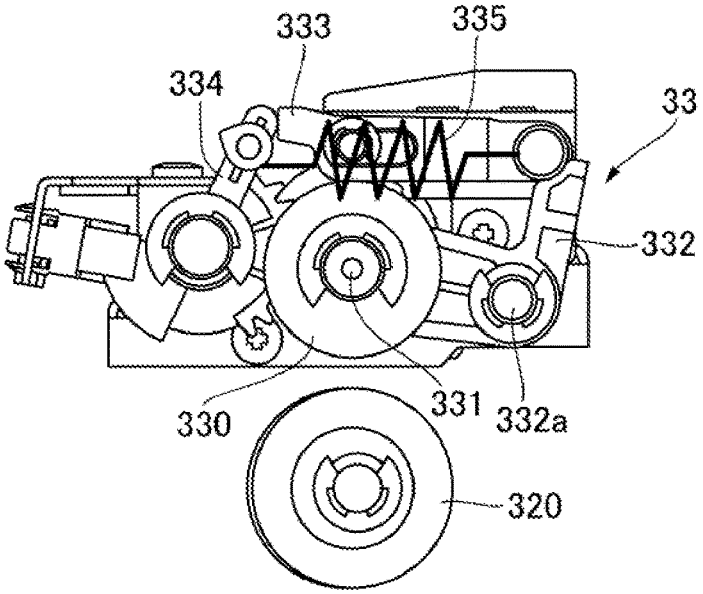
FIG. 7B is a side view illustrating the pressing mechanism in a released state.

Next, the configuration of the skew-feed correction portion 30 will be described in detail using FIG. 5A, FIG. 5B, FIG. 6A, FIG. 6B, FIG. 7A and FIG. 7B. FIG. 5A is a schematic diagram of the skew-feed correction portion 30 as viewed from above. FIG. 5B is a schematic diagram illustrating a cross-sectional configuration of the reference member 300 as viewed from the sheet conveyance direction Dx. FIG. 6A is a perspective view illustrating a pressing configuration of an oblique-feed unit, and FIG. 6B is a side view thereof. FIG. 7A and FIG. 7B are schematic diagrams illustrating a pressure state and a released state of an oblique-feed unit.

As illustrated in FIG. 5A, the rotational axis of the oblique-feed rollers 321 to 323 is fixed in an inclined state in conformity with the aforementioned angle α using a universal joint 32*c*. The respective oblique-feed rollers 321 to 323 are connected to an oblique-feed driving motor Ms that is a drive unit through a power transmission mechanism that includes the universal joint 32*c*, a belt 32*a* and a pulley 32*b*. The oblique-feed driving motor Ms is a stepping motor, and the driving speed and the timing for starting and stopping driving thereof can be controlled.

As illustrated in FIG. 5B, the reference member 300 has a cross-section that is a concave shape which is constituted by the reference face 301 which a side edge of the sheet S butts against, an upper guide face 302 which faces the upper surface of the sheet S, and a lower guide face 303 which faces the undersurface of the sheet S. A member made of die-cast aluminum in which the reference face 301 is made with accuracy by cutting and in which the reference face 301 is also subjected to an electroless nickel treatment with PTFE (polytetrafluoroethylene) can be suitably used as the reference member 300. By employing such a member, the reference face 301 that has a high degree of flatness and a high level of slipperiness (small frictional resistance with respect to the sheet S) is obtained. Thus, the accuracy of the skew-feed correction of the sheet S can be improved.

As illustrated in FIG. 6A, FIG. 6B, FIG. 7A and FIG. 7B, a pressing mechanism 33 that is capable of switching between a pressure state in which it is possible to nip and convey the sheet S at a nip portion between an oblique-feed roller 320 and a driven roller 330 that faces the oblique-feed roller 320 and a released state in which the pressure state is released is disposed in the skew-feed correction portion 30. Note that, the term "released state" is not limited to a state in which the nip portion is open, and includes a case where rollers contact each other with a weaker force compared to the pressure state. Further, the term "pressure state of the oblique-feed unit" indicates that at least one oblique-feed roller is in a pressure state, and the term "released state of the oblique-feed unit" indicates that all of the oblique-feed rollers are in a released state.

Note that, in the skew-feed correction portion 30, in a state in which the oblique-feed roller 320 illustrated in FIG. 6A, FIG. 6B, FIG. 7A and FIG. 7B is replaced with any one of the oblique-feed rollers 321 to 323, a plurality of sets of the driven roller 330 and the pressing mechanism 33 are disposed. In other words, the pressing mechanism 33 as a changeover unit that is capable of switching between the pressure state and the released state is provided in correspondence with each of the oblique-feed rollers 321 to 323. Further, in a case where the oblique-feed roller is added to the oblique-feed unit 32, the pressing mechanism 33 is provided for each of the oblique-feed rollers.

As illustrated in FIG. 6A and FIG. 6B, the pressing mechanism 33 includes an arm member 332, a link member 333, a pressing gear 334, a pressing spring 335, and an oblique-feed pressure motor Mk. The driven roller 330 is supported so as to be rotatable around a driven shaft 331 by the arm member 332, and is movable in a direction to approach or a direction to separate from the oblique-feed roller 320 by rocking of the arm member 332. Although the driven roller 330 in the present embodiment rotates along the sheet conveyance direction around an axis that extends in the width direction, a configuration may also be adopted in which the driven roller 330 is disposed on an axis that is parallel to the corresponding oblique-feed roller. The arm member 332 is connected to the pressing gear 334 through the pressing spring 335 and the link member 333. The pressing gear 334 is connected to an output shaft of the oblique-feed pressure motor Mk that is a drive source.

As illustrated in FIG. 7A, in the pressure state, the pressing gear 334 rotates in the counterclockwise rotation direction in FIG. 7A, and the arm member 332 that is pulled by the pressing spring 335 rocks in the counterclockwise rotation direction around a rocker shaft 332*a*. As a result, a state is entered in which the driven roller 330 presses against the oblique-feed roller 320. On the other hand, as illustrated in FIG. 7B, in the released state, the pressing gear 334 rotates in the clockwise rotation direction in FIG. 7B and presses the link member 333, and the link member 333 causes the arm member 332 to rock in the clockwise rotation direction. As a result, the driven roller 330 separates from the oblique-feed roller 320, and a state is entered in which at least an abutment pressure on the oblique-feed roller 320 is lower in comparison to the pressure state.

The oblique-feed pressure motor Mk is a stepping motor, and the extension amount of the pressing spring 335 in the pressure state can be changed by controlling the rotational angle of the pressing gear 334. That is, the pressing mechanism 33 according to the present embodiment acts as a change unit that is capable of changing between the pressure state and the released state, and is also capable of changing a pressure force in the pressure state.

Figure 8:
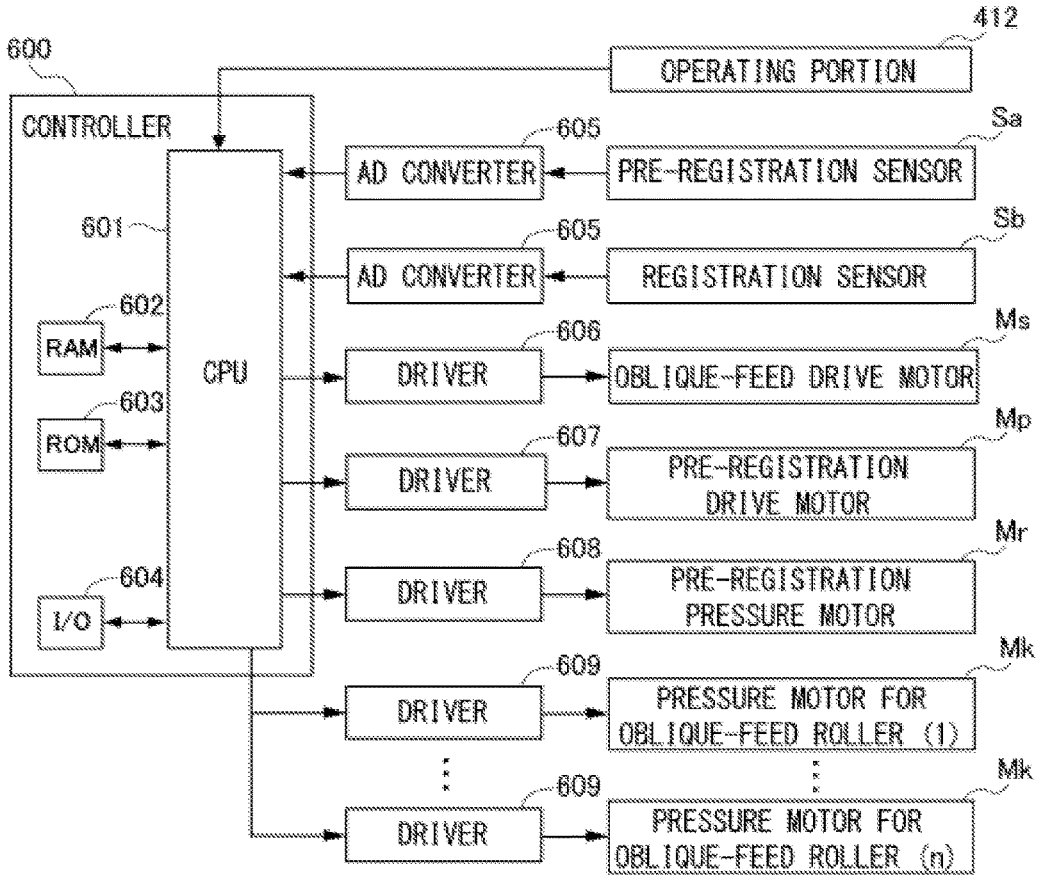
FIG. 8 is a block diagram illustrating a control configuration of a registration portion.

The control configuration of the registration portion 50 will now be described. As illustrated in the block diagram in FIG. 8, operations of the registration portion 50 are controlled by a controller 600 mounted in the image forming apparatus. The controller 600 that is one example of a control unit includes a central processing unit (CPU) 601, a rewritable memory (RAM) 602 and read-only memory (ROM) 603 that are storage units, and an interface (I/O) 604 with respect to an external device or a network.

The CPU 601 performs control based on information that is input through an operating portion 412 that is a user interface, and detection signals received through AD converters 605 from the aforementioned pre-registration sensor Sa and registration sensor Sb. The CPU 601 reads out and executes a program stored in the ROM 603 or the like, and controls driving of the group of motors (Ms, Mp, Mr, Mk) that are actuators of the registration portion 50 through drivers 606, 607, 608 and 609. By this means, the CPU 601 is configured to be capable of executing the respective processes of a control method described hereunder. Note that, the oblique-feed pressure motors Mk are provided in a quantity (n) that corresponds to the number of oblique-feed rollers, and the CPU 601 is capable of independently controlling the existence/non-existence of pressing as well as the size of a pressure force of the driven rollers with respect to each oblique-feed roller.

(Registration Portion Control Method)

Figure 9:
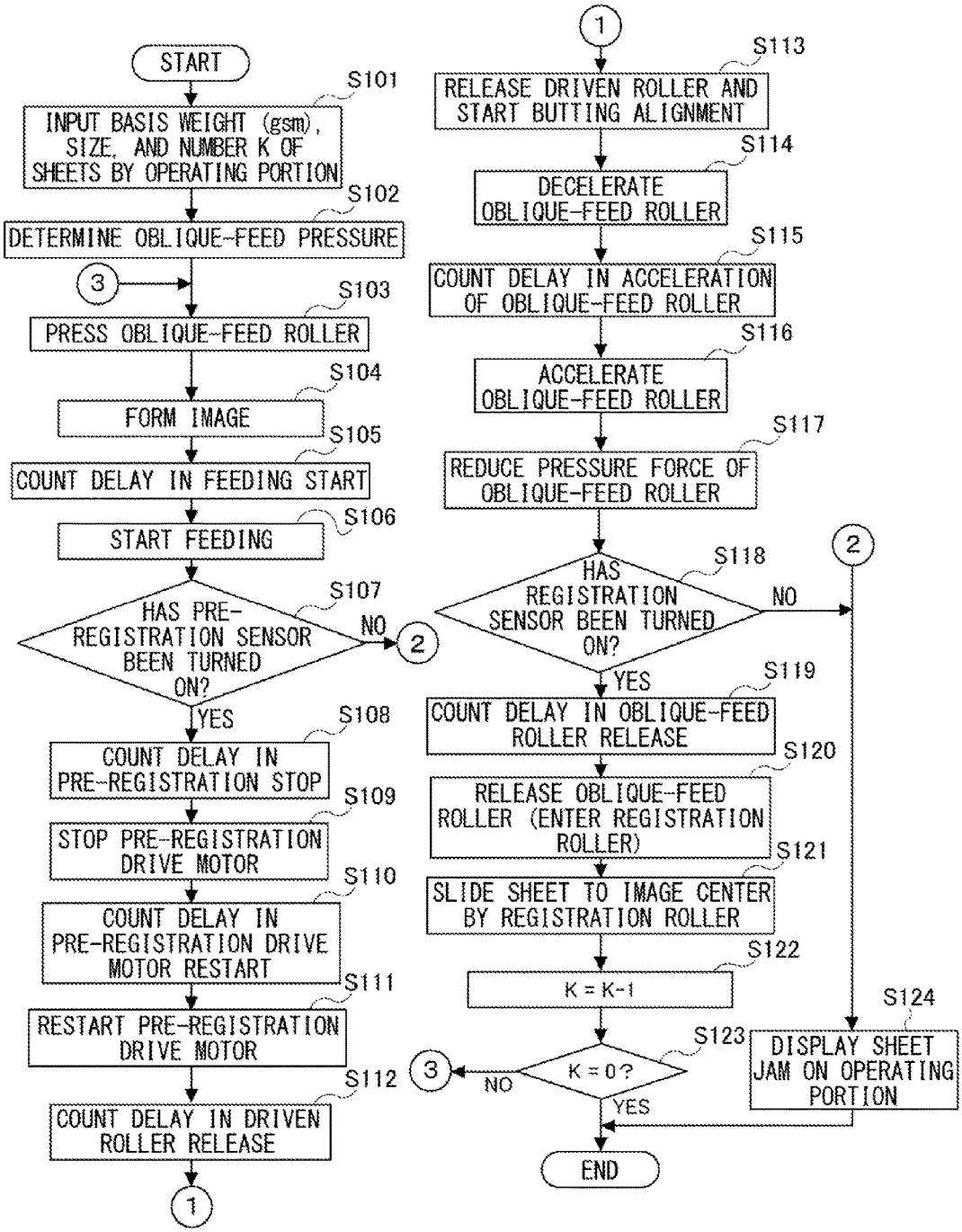
FIG. 9 is a flowchart illustrating a method for controlling a registration portion in Embodiment 1.

Hereunder, a method for controlling a sheet conveying operation in the registration portion 50, and the behavior of a sheet during a sheet conveying operation are described in accordance with a flowchart shown in FIG. 9 while referring as appropriate to FIG. 2A, FIG. 2B, FIG. 2C, FIG. 2D, FIG. 10 and FIG. 11. It is assumed that during execution of the flowchart described hereunder, the respective oblique-feed rollers are being rotationally driven continuously.

When an image formation job is started (S101) in a state in which information such as the basis weight, size and number of sheets that are the object of image formation has been input through the operating portion 412, the oblique-feed pressures of the respective oblique-feed rollers 321 to 323 of the oblique-feed unit 32 are determined (S102). The term "oblique-feed pressure" refers to a pressure force of the driven roller 330 with respect to each oblique-feed roller, that is, the nip pressure applied to a sheet by the oblique-feed roller and the driven roller, and the oblique-feed pressure is determined for each of the oblique-feed rollers 321 to 323 based on a table that is stored in advance in the ROM 603 or the like. The size of the oblique-feed pressure is set according to the basis weight of the sheet so that the larger the basis weight of a sheet is, the larger the oblique-feed pressure value that is set for the relevant sheet, to thereby enable stable conveying irrespective of the kind of sheet. Pressing of the oblique-feed rollers 321 to 323 is then started based on the determined oblique-feed pressures to enter a pressure state (S103).

Figure 2A:
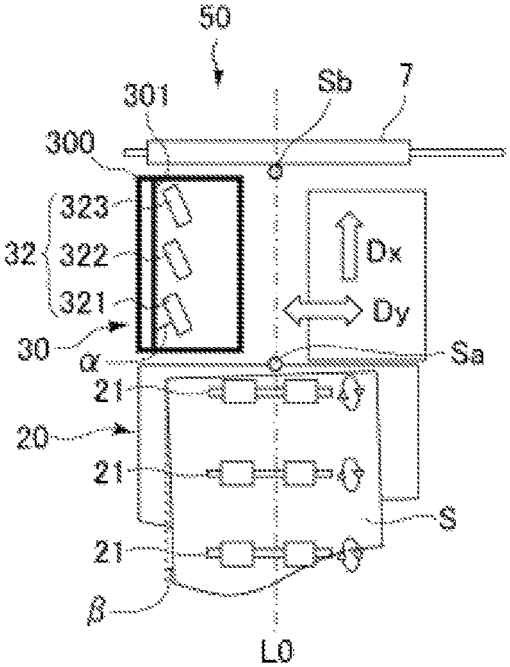
FIG. 2A, FIG. 2B, FIG. 2C and FIG. 2D are schematic diagrams that respectively represent a first stage, a second stage, a third stage and a fourth stage of a sheet conveying operation performed by a registration portion.

Thereafter, when an image forming operation by the image forming portions PY to PK is started (S104), a delay time period until the start of feeding is counted (S105) that is based on the start timing of the image forming operation, and thereafter a sheet is fed from the feeding cassette 51 (S106, FIG. 2A). Subsequently, upon the pre-registration sensor Sa detecting that a sheet has been delivered to the pre-registration conveyance portion 20 (S107), a stop delay time period is counted (S108), and thereafter the pre-registration drive motor Mp is stopped (S109). Note that, in a case where the pre-registration sensor Sa does not detect a sheet even after a predetermined time period passes from the time that feeding started, a screen indicating there is a sheet jam is displayed on the operating portion (S124), and execution of the job ends.

Thereafter, a delay time period until restarting in conformity with the progress of the image forming operation is counted (S110), and driving of the pre-registration drive motor Mp is restarted (S111). Because the timing for restarting driving by the pre-registration drive motor Mp is adjusted in conformity with the image forming operation, variations in the time period until a sheet arrives at the pre-registration sensor Sa are absorbed. Thereafter, a delay time period until pressing of the pairs of conveying rollers 21 of the pre-registration conveyance portion 20 is released is counted (S112), and then the driven rollers 24 separate from the driving rollers 23 and the respective pairs of conveying rollers 21 enter a separated state (S113). As a result, a butting alignment operation that butts a sheet against the reference member 300 to correct skewness is started. The butting alignment operation in the flowchart illustrated in FIG. 9 is a period (S113 to S120) from when pressing of the pairs of conveying rollers 21 is released until the oblique-feed unit 32 enters a released state.

Figure 2B:
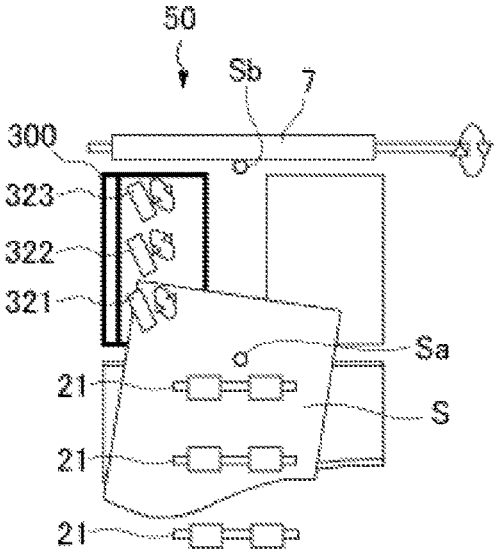

Upon pressing of the pair of conveying rollers 21 being released, as illustrated in FIG. 2B, by means of a conveying force received from the oblique-feed unit 32, the sheet starts to move diagonally relative to the sheet conveyance direction so as to approach the reference member 300. That is, the sheet S is subjected to oblique feeding along a tangential direction of the oblique-feed rollers 321 to 323 that are inclined with respect to the sheet conveyance direction Dx, and is shifted to the side toward the reference face 301 of the reference member 300. The sheet S then comes even closer to the reference member 300, and the side edge of the sheet S abuts against the reference face 301. By this means, in a case where the side edge of the sheet S in the pre-correction state was inclined (angle β in FIG. 2A) with respect to the sheet conveyance direction Dx, the side edge is caused to follow the reference face 301 so that a skew of the sheet S is corrected. Note that, the actual movement direction of the sheet does not necessarily match a tangential direction of the oblique-feed rollers because slippage occurs at the oblique-feed roller due to inertia of the sheet and the influence of conveying resistance with respect to the sheet and the like.

In the present embodiment, after the start of a butting alignment operation, processing that decelerates the driving speed of the oblique-feed rollers 321 to 323 is performed (S114). Subsequently, based on the timing at which the front end of the sheet, that is, the downstream end in the sheet conveyance direction Dx, is detected by the pre-registration sensor Sa, a delay time period for accelerating the driving speed of the oblique-feed rollers 321 to 323 is counted (S115). The length of the aforementioned delay time period is set so that acceleration of the driving speed is executed after the side edge of the sheet abuts against the reference face 301 of the reference member 300. Subsequently, after the delay time period elapses, a process that increases the driving speed of the oblique-feed unit 32 (S116), and a process that reduces the force with which the oblique-feed unit 32 nips the sheet (S117) are executed. The aforementioned process to accelerate the driving speed and process to reduce the pressure (S116 and S117) of the oblique-feed unit 32 are described in detail later.

Figure 2C:
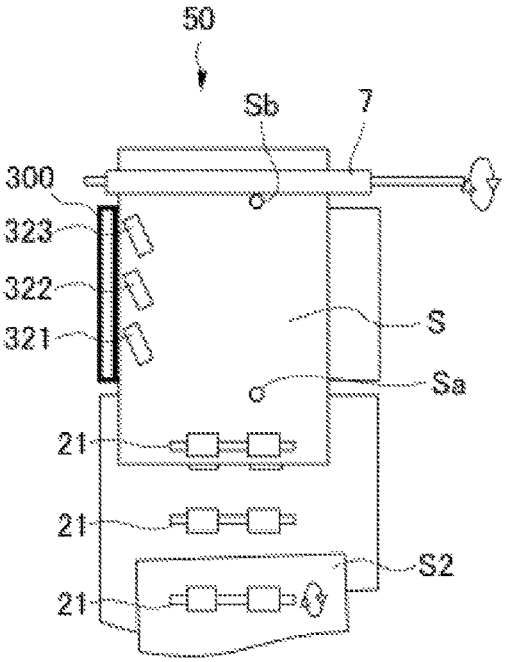

Upon the registration sensor Sb detecting the front end of the sheet (S118), a delay time period for releasing the pressing of the oblique-feed rollers 321 to 323 is counted (S119), and then the pressing of the oblique-feed rollers 321 to 323 is released and the oblique-feed rollers 321 to 323 enter a released state (S120; FIG. 2C). The aforementioned delay time period is set so that the oblique-feed rollers 321 to 323 enter a released state after the front end of the sheet enters the nip portion of the registration rollers 7. Note that, if the registration sensor Sb does not detect a sheet within a predetermined time period, a screen indicating there is a sheet jam is displayed on the operating portion (S124), and execution of the job ends.

Figure 2D:
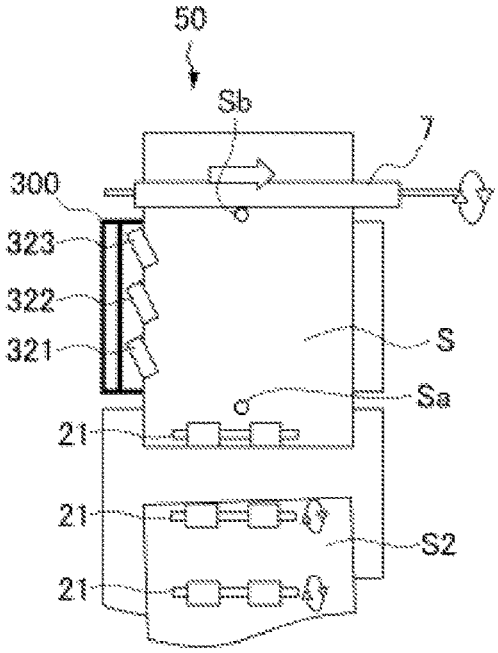

When the sheet is delivered to the registration rollers 7, as illustrated in FIG. 2D, the registration rollers 7 move in the width direction while conveying the sheet. By this means, the center position of the sheet in the width direction Dy is positioned in alignment with the center position of the image formed by the image forming portions PY to PK (S121). Upon the sheet being sent to the secondary transfer portion, a counter that manages the number of remaining sheets K that are to be subjected to image formation decrements the value of K (S122). If the number of remaining sheets K is not 0, that is, if sheets that are to be subjected to image formation remain ("No" in S123), the above described operations (S103 to S122) are repeated. At such time, in the pre-registration conveyance portion 20, by the pairs of conveying rollers 21 through which the rear end of the leading sheet S passed being pressed in sequence (see FIG. 2C and FIG. 2D) to thereby nip a succeeding sheet S2, sheets are continuously conveyed and supplied to the secondary transfer portion. When the number of remaining sheets K is 0 ("Yes" in S123), it is determined that the image forming operation is completed, and execution of the job ends.

(Suppression of Sheet Turning)

Next, the oblique-feed roller acceleration process (S116) and the process that reduces the pressure force of the oblique-feed unit 32 (S117) accompanying the acceleration process will be described in detail. In general, although the productivity of the image forming apparatus increases as the conveying speed of sheets increases, on the other hand, the faster that the conveying speed is, the greater the impact when the sheets contact against the reference member and the greater the concern that buckling of sheets will occur. In the present embodiment, the oblique-feed rollers 321 to 323 of the oblique-feed unit 32 are rotationally driven at a relatively slow speed until the relevant sheet contacts against the reference member 300, and the driving speed of the oblique-feed rollers 321 to 323 is increased after the sheet has contacted against the reference member 300.

In other words, after the sheet is caused to abut against the abutment surface in a first state in which the oblique-feed unit is driven at a comparatively low first speed (V1 in FIG. 10), control is executed that changes over to a second state in which the oblique-feed unit is driven at a comparatively high second speed (V2). By this means, the impact applied to the sheet at the time of contact is lessened, and productivity can also be ensured.

Figure 11:
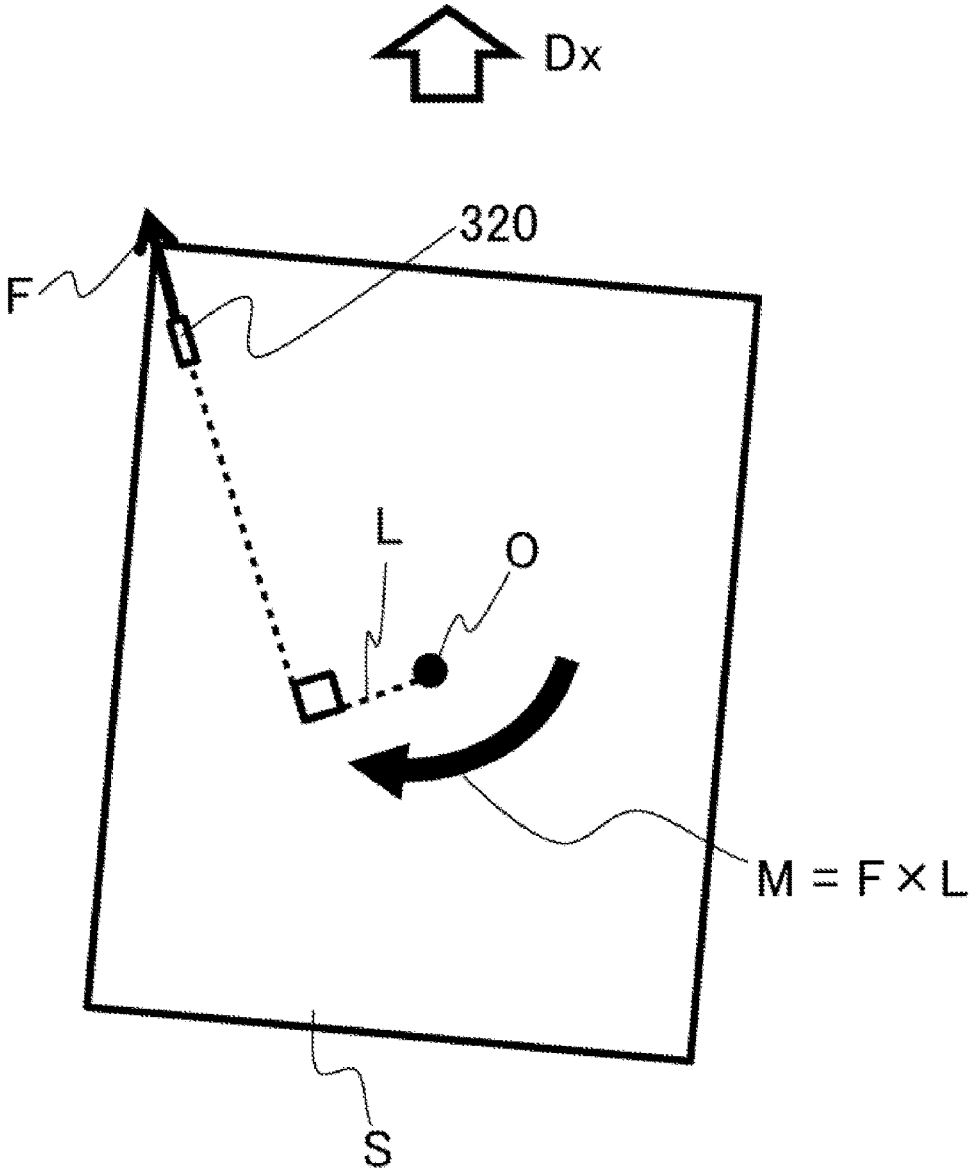
FIG. 11 is a schematic diagram for describing the behavior of a sheet accompanying acceleration of an oblique-feed unit.

However, when performing the acceleration process, it is necessary to take care so that the posture of the sheet which underwent skew-feed correction by contacting against the reference member is not disturbed again. In a case where a sheet with a mass "m" is accelerated at an accelerated velocity "a" by acceleration of the oblique-feed rollers, a force of $F=m\times a$ (hereunder, referred to as "accelerating force F") acts on the sheet in comparison to the state before acceleration. At this time, as illustrated in FIG. 11, in some cases a moment M attributable to the accelerating force F arises that attempts to turn the sheet ($M=F\times L$; L: length of moment arm produced by accelerating force F), and the posture of the sheet is disturbed.

The behavior of the sheet due to this phenomenon is determined by the relation between the points of application of the accelerating force F and directions of the accelerating force F, and the center of the moment. The point of application of the accelerating force F is the contact position between the oblique-feed roller and the sheet. In FIG. 11, one oblique-feed roller 320 is illustrated for description purposes. The term "directions of the accelerating force F" refers to the rotational directions of the oblique-feed rollers at the positions of contact with the sheet. The term "center of the moment" refers to, in a case where the conveying resistance with respect to a sheet is divided by area with respect to a first face and a second face of the sheet, a position at which the respective conveying resistance amounts balance out, and is the apparent center of gravity position of the sheet. When it is assumed that the conveying resistance with respect to the sheet is uniform, the center of the moment matches the center of gravity position of the sheet. In practice, the center of the moment does not necessarily match the center of gravity position of the sheet due to factors such as differences in the coefficient of friction with respect to the sheet between the pairs of conveying rollers and the conveying guides or curves in the sheet conveyance path and the like. Experimentally, the center of the moment can be estimated by, for example, observing the turning direction of the sheet in a case where the sheet is accelerated while changing the conditions for the angle and position of only a single oblique-feed roller that is provided.

In the present embodiment, an inclination angle $\alpha$ (see FIG. 2A) with respect to the sheet conveyance direction Dx of the direction of oblique feeding by the respective oblique-feed rollers 321 to 323 of the oblique-feed unit 32 can be small to a certain extent to reduce an impact between the sheet S and the reference member 300. For example, it is suitable to make the angle $\alpha$ 20 degrees or less, and more suitably the angle $\alpha$ can be made 15 degrees or less. Further, to reduce a loop in a sheet that is butted against the reference face 301 and improve the accuracy of a butting alignment operation, it is suitable to dispose the oblique-feed rollers 321 to 323 in the vicinity of the reference face 301 (at least, at a position that is closer to the reference face 301 than the conveyance center L0). In the case of using oblique-feed rollers arranged in this manner, as illustrated in FIG. 11, when the driving speed of the oblique-feed rollers is increased, a moment M arises that attempts to rotate the sheet S in the clockwise rotation direction in FIG. 11 that is caused by the accelerating force F.

Figure 10:
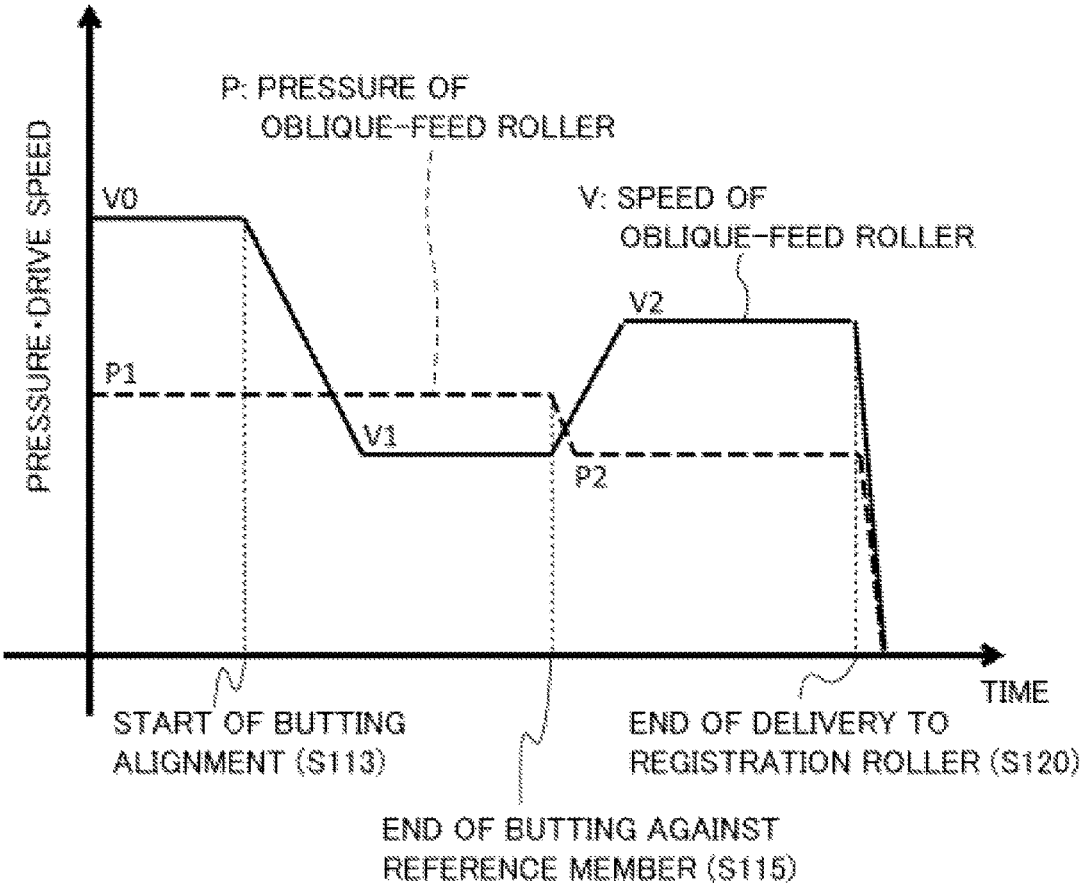
FIG. 10 is a graph representing settings for a driving speed and a pressure force of an oblique-feed roller.

Based on this knowledge, in the present embodiment, when performing the acceleration process, turning of the sheet S is suppressed by weakening the force with which the oblique-feed unit 32 nips the sheet S. As illustrated in FIG. 10, when a butting alignment operation (S113) is started, the oblique-feed rollers 321 to 323 which were being driven at a speed V0 are decelerated to the first speed V1 to perform butting (S114). At this time, the pressure force of the respective oblique-feed rollers 321 to 323 is set to a first abutment pressure P1 that is the value for the oblique-feed pressure that was already determined (S102). Thereafter, when it is determined based on the elapse of an acceleration delay time period that the sheet S abutted against the reference member 300 and a skew of the sheet S was corrected (S115), the process to accelerate the oblique-feed rollers 321 to 323 (S116) and the process to reduce the pressure force of the oblique-feed rollers 321 to 323 (S117) are executed. That is, the driving speed of each of the oblique-feed rollers 321 to 323 is accelerated to a second speed V2 that is higher than the first speed V1, and the pressure force of each of the oblique-feed rollers 321 to 323 is changed to a second abutment pressure P2 that is lower than the first abutment pressure P1.

In other words, in a case where, after the oblique-feed unit causes the sheet to abut against the abutment surface in a first state in which the sheet is driven at a first speed, the state is changed over to a second state in which the driving speed of the oblique-feed unit is accelerated to a second speed, and the pressure force of the oblique-feed unit in the second state is set to a lower pressure force in comparison with the first state. By this means, in the second state after the sheet has abutted against the abutment surface, a moment M that is produced by the oblique-feed unit is reduced. Further, as a result of the force with which the oblique-feed unit nips the sheet weakening, the sheet can slip easily against the oblique-feed unit at the nip portion. That is, it is easy for a sheet to move in the sheet conveyance direction Dx while slipping against the circumferential faces of the oblique-feed rollers 321 to 323 that are disposed in an inclined manner relative to the sheet conveyance direction Dx, and the posture of the sheet for which a skew was corrected by the reference member 300 is easily maintained.

Thus, because turning of the sheet after abutting against the abutment surface is suppressed, the posture of the sheet in the state in which a skew was corrected by the abutment surface is maintained, and the accuracy of skew-feed correction can be enhanced. Further, by suppressing turning of the sheet, the possibility of, for example, the sheet colliding against an edge in the sheet conveyance direction of the reference member 300 and being damaged can be reduced.

The following methods (1) to (3) may be mentioned as methods that weaken the force with which the oblique-feed unit 32 nips the sheet S.

(1) A method that weakens the pressure force of each of the three oblique-feed rollers.

(2) A method that releases the pressing of one or two of the three oblique-feed rollers.

(3) A method that releases the pressing of one or two of the three oblique-feed rollers, and weakens the pressure force of the remaining oblique-feed roller(s).

It is possible to appropriately change the methods described above in (1) to (3) in accordance with, for example, the kind of sheet or circumstances such as the environmental conditions or the like. Note that, in the case of executing the method of (2) or (3), it is suitable to set an oblique-feed roller on the upstream side in a released state while keeping an oblique-feed roller of the downstream side in a pressure state. That is, when the oblique-feed unit has a configuration that includes a first nip portion (for example, the oblique-feed roller 321; see FIG. 2C) and a second nip portion (for example, the oblique-feed roller 322) that is downstream of the first nip portion, it is suitable to set only the second nip portion in the released state after the sheet abuts against the abutment surface. Because the center of a moment moves downstream in the sheet conveyance direction Dx accompanying conveyance of the sheet S, by setting the oblique-feed roller on the upstream side in the released state with priority over the oblique-feed roller on the downstream side, a length L of a moment arm can be suppressed compared to a case where the oblique-feed roller on the downstream side is set in the released state. For a similar reason, in the method of (1) or (3), in the case of setting the pressure forces of the oblique-feed rollers so that there is a difference therebetween, it is suitable to set the pressure forces so that the pressure force of the oblique-feed roller on the downstream side is larger than the pressure force of the oblique-feed roller on the upstream side.

Note that, whether or not it is necessary to decelerate the oblique-feed rollers 321 to 323 when starting a butting alignment operation (S113) depends on the relative relation between the conveying speed of a sheet in the pre-registration conveyance portion 20 and the first speed V1. That is, the driving speed V0 of the oblique-feed unit 32 when butting alignment starts is set to conform with the conveying speed of the pairs of conveying rollers 21, for example, with a component in the sheet conveyance direction Dx being set so as to be approximately equal to the conveying speed of the pairs of conveying rollers 21. By this means, a shock when a sheet is delivered from the pairs of conveying rollers 21 to the oblique-feed unit 32 is reduced and the behavior of the sheet can be stabilized. Further, in a case where the driving speed V0 of the oblique-feed unit 32 that is set in this way is higher than a speed at which it is possible to adequately suppress buckling of a sheet that is caused by impact with the reference member 300, that is, is higher than the first speed V1, deceleration is performed at the start of the butting alignment operation. Note that, the conveying speed of the pairs of conveying rollers 21 is set in consideration of the processing speed of sheets in the overall image forming apparatus 1, for example, in conformity with the sheet feeding speed of the sheet feeding portion 54 (see FIG. 1) or the like.

Further, in the present embodiment, although acceleration (S116) and a reduction in the pressure force (S117) of the oblique-feed rollers 321 to 323 are started simultaneously (see FIG. 10), the timings for starting and ending these processes may be staggered so that turning of the sheets can be reduced as much as possible.

(Long Sheet)

Next, the relation between a long sheet and the present embodiment will be described. In a case where the angle $\alpha$ of the oblique-feed rollers 321 to 323 in FIG. 2A is comparatively small, the sheet S moves at a small inclination angle with respect to the sheet conveyance direction, and is gradually shifted to the side toward the reference member 300. That is, a moving distance of the sheet in the sheet conveyance direction during a period from when the oblique-feed unit 32 starts to shift the sheet S toward the side until a side edge of the sheet S abuts against the reference face 301 of the reference member 300 is long. However, because it is necessary to enable opening of at least the pair of conveying rollers 21 for which there is a possibility of the sheet S abutting against at the position at which the operation to shift the sheet S to the side starts, the size and degree of complexity of the configuration of the apparatus increases by an amount that corresponds to the mechanical structure that moves the pairs of conveying rollers 21 as well as the control configuration thereof.

In particular, in the case of a long sheet, that is, a sheet in which the ratio between a long side and a short side is large compared to standards that are widely used such as A size and B size sheets, the number of pairs of conveying rollers 21 that it is required to enable opening of is large. For example, in the case of handling a long sheet S having a length from the sheet feeding portion 54 to the skew-feed correction portion 30 in FIG. 1, it is considered that the necessity will arise to separate the pairs of conveying rollers 54*b* of the feeding path 54*a*. Note that, apart from the structure for moving the pairs of conveying rollers, in a section in which a sheet is subjected to oblique feeding, for example, it is necessary to adopt a measure such as avoiding as much as possible curving of the sheet conveyance path to suppress conveying resistance of the sheet, and this leads to an increase in the size and complexity of the apparatus.

Therefore, it is conceivable to set the angle α of the oblique-feed rollers 321 to 323 to a large angle. The larger that the angle α is, the further on the downstream side in the sheet conveyance direction that the position at which starts shifting the sheet S to the side can be set, and hence a configuration for separating some pairs of conveying rollers 21 on the upstream side can be omitted to thereby enable downsizing and simplification of the apparatus. However, the moving velocity in the width direction Dy of the sheet S that is obliquely fed by the oblique-feed unit 32 increases, and there is a concern that the side edge of the sheet S will be butted strongly against the reference member 300 and buckling of the sheet S will occur.

In this case, in the present embodiment, the sheet is butted against the reference member 300 in a state in which the driving speed of the oblique-feed rollers 321 to 323 is decelerated (S114) after the start of the butting alignment operation. Therefore, buckling of sheets can be reduced even if the angle α of the direction of oblique feeding by the oblique-feed rollers 321 to 323 with respect to the sheet conveyance direction Dx (see FIG. 2A) is set to an angle that is large to a certain extent (for example, even if the angle α is set to 10 degrees or more). Therefore, it is possible to suppress an increase in the size and complexity of the apparatus while also avoiding buckling of sheets when dealing with long sheets.

According to the sheet conveyance apparatus of the present embodiment, turning of sheets can be suppressed.

(Other Embodiments)

Although in the foregoing embodiment the oblique-feed unit 32 having the three oblique-feed rollers 321 to 323 is described as an example of an oblique-feed unit that obliquely feeds sheets, a configuration may be adopted that has another oblique-feed unit instead of or in addition to the oblique-feed unit 32. For example, another oblique-feed unit may be disposed at a different position to the oblique-feed unit 32 with respect to the width direction.

Although in the foregoing embodiment a registration portion that is arranged upstream of a transfer portion at which transferring of images is performed is described as an example of a sheet conveyance apparatus, the present technology is also applicable to other sheet conveyance apparatuses that adopt a side registration method. For example, the present technology can be used as an apparatus that conveys sheets while correcting skews of the sheets inside a sheet processing apparatus that is connected to the main body of an image forming apparatus, or as an apparatus that conveys sheets while correcting skews of the sheets in the two-sided conveyance portion 502 (see FIG. 1). That is, a sheet conveyance apparatus is not limited to an apparatus that is housed in the main body of an image forming apparatus or to an apparatus that is used for sheet conveyance prior to image formation.

Embodiments of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-143099, filed Jul. 24, 2017, which is hereby incorporated by reference herein in its entirety.

What is claimed is:

1. A sheet conveyance apparatus, comprising:

an abutment surface extending along a sheet conveyance direction and configured to abut against an edge, in a width direction orthogonal to the sheet conveyance direction, of a sheet passing through a sheet conveyance path;

an oblique-feed unit configured to nip and convey the sheet by imparting to the sheet a force in a direction inclined relative to the sheet conveyance direction so that the sheet approaches the abutment surface in the width direction as the sheet proceeds downstream in the sheet conveyance direction;

a conveyance unit disposed upstream of the oblique-feed unit with respect to the sheet conveyance direction and configured to convey the sheet downstream in the sheet conveyance direction;

a detector configured to detect the sheet at a detection position downstream of the conveyance unit with respect to the sheet conveyance direction;

a drive unit configured to drive the oblique-feed unit;

a change unit configured to change a force with which the oblique-feed unit nips the sheet; and a control unit configured to control the drive unit and the change unit so that, after causing the sheet to abut against the abutment surface in a first state in which the oblique-feed unit is driven at a first speed, based on a detection signal from the detector, the oblique-feed unit is put into a second state in which the oblique-feed unit is driven at a second speed higher than the first speed and the force with which the oblique-feed unit nips the sheet is weaker than that in the first state.

2. The sheet conveyance apparatus according to claim 1, wherein the change unit is configured to change a nip pressure with which the oblique-feed unit nips the sheet; and wherein the control unit sets the nip pressure of the oblique-feed unit in the second state to be lower than the nip pressure of the oblique-feed unit in the first state.

3. The sheet conveyance apparatus according to claim 1, wherein the oblique-feed unit includes a first nip portion and a second nip portion, each of which is configured to nip the sheet;

wherein the change unit is configured to change the first nip portion between a pressure state in which the first nip portion nips the sheet and a released state in which the pressure state is released, and the change unit is configured to change the second nip portion between a pressure state in which the second nip portion nips the sheet and a released state in which the pressure state is released; and wherein in the first state, the control unit sets the first nip portion and the second nip portion to the pressure state, and in the second state, the control unit sets the first nip portion to the released state and sets the second nip portion to the pressure state.

4. The sheet conveyance apparatus according to Claim 1, wherein the conveyance unit is a pair of conveying rollers configured to change over between a state in which the pair of conveying rollers nips and conveys the sheet at a nip portion and a state in which the nip portion is opened, and wherein the control unit opens the nip portion of the pair of conveying rollers in a state in which the oblique-feed unit is driven at a speed higher than the first speed by the drive unit, and thereafter decelerates a driving speed of the oblique-feed unit by the drive unit to the first speed to cause the oblique-feed unit to enter the first state.

5. The sheet conveyance apparatus according to claim 1, wherein the control unit performs a changeover from the first state to the second state in a state in which the oblique-feed unit is continuously driven by the drive unit.

6. The sheet conveyance apparatus according to claim 1, further comprising a second conveyance unit disposed downstream of the oblique-feed unit in the sheet conveyance direction and configured to convey the sheet, wherein, based on the detection signal from the detector, the control unit causes the drive unit to drive the oblique-feed unit at the second speed during a period from a time when the oblique-feed unit is changed over to the second state to a time when at least a downstream end, in the sheet conveyance direction, of the sheet arrives at the second conveyance unit.

7. The sheet conveyance apparatus according to claim 1, wherein the oblique-feed unit has a roller member which is rotatable around an axis inclined relative to the width direction so as to be inclined upstream with respect to the sheet conveyance direction as the axis approaches the abutment surface in the width direction.

8. The sheet conveyance apparatus according to claim 1, further comprising an image forming unit configured to form an image on the sheet of which a skew is corrected by being butted against the abutment surface by the oblique-feed unit.

* * * * *